US005144710A

United States Patent [19]

Grossman

[11] Patent Number: 5,144,710

[45] Date of Patent: Sep. 8, 1992

[54] COMPOSITE, PRESTRESSED STRUCTURAL MEMBER AND METHOD OF FORMING SAME

[76] Inventor: Stanley J. Grossman, 10408 Greenbriar Pl., Oklahoma City, Okla. 73159

[21] Appl. No.: 662,467

[22] Filed: Feb. 28, 1991

[51] Int. Cl.[5] ..... E01D 19/12; E04C 3/02

[52] U.S. Cl. ..... 14/73; 14/74.5

[58] Field of Search ..... 52/227, 174; 14/17, 14/73, 1

[56] References Cited

U.S. PATENT DOCUMENTS

| | | | |
|---|---|---|---|
| 2,725,612 | 12/1955 | Lipski | 25/154 |
| 2,730,797 | 1/1956 | Lipski | 29/452 |
| 3,577,504 | 5/1971 | Lipski | 264/255 |
| 3,588,971 | 6/1971 | Lipski | 25/188 T |
| 3,608,048 | 8/1971 | Lipski | 264/228 |
| 3,618,889 | 11/1971 | Lipski | 249/50 |
| 4,493,177 | 1/1985 | Grossman | 52/745 |
| 4,531,857 | 7/1985 | Bettigole | 14/73 X |
| 4,604,841 | 8/1986 | Barnoff | 14/73 X |
| 4,620,400 | 11/1986 | Richard | 14/73 X |
| 4,646,493 | 3/1987 | Grossman | 52/223 R |
| 4,700,516 | 10/1987 | Grossman | 52/223 R |

FOREIGN PATENT DOCUMENTS

| | | | |
|---|---|---|---|
| 737545 | 6/1980 | U.S.S.R. | 14/17 |
| 1474201 | 4/1989 | U.S.S.R. | 14/17 |

OTHER PUBLICATIONS

Exhibit A—Drawing of Prior Art Bridge Built in Kiowa County, Oklahoma, Around 1987.

*Primary Examiner*—Ramon S. Britts
*Assistant Examiner*—Nancy Connolly
*Attorney, Agent, or Firm*—Laney, Dougherty, Hessin & Beavers

[57] ABSTRACT

A composite, prestressed structural member, such as a bridge unit and methods of forming such a member. The apparatus includes a plurality of longitudinally extending girders which are transversely spaced and a plurality of adjacent composite units disposed on the girders. Each composite unit has a plurality of beams with a molded deck portion formed thereabove. The beams are positioned transversely with respect to the girders and attached thereto. Additional, longitudinal beams are disposed between the transversely extending beams over the girders. The longitudinal beams are attached to the girders and by connectors to the molded deck. The structure is formed by positioning the girders on a construction support adjacent to a center portion of the girders such that the free ends of the girders cantilever and deflect downwardly. The beams of the composite units are attached to the girders in this construction position. Any gaps between adjacent composite units are filled with a non-shrink, high strength grout. When moved to an operating position wherein opposite ends of the girders are supported, the natural deflection of the unit due to its weight imparts a compressive prestress longitudinally in the molded deck units. Each molded deck unit may be formed such that it is also transversely prestressed.

17 Claims, 3 Drawing Sheets

COMPOSITE, PRESTRESSED STRUCTURAL MEMBER AND METHOD OF FORMING SAME

BACKGROUND OF THE INVENTION

1. Field of the Invention

This invention relates in general to prestressed structural members and methods of forming such structural members, and more particularly, to a composite, prestressed structural member, such as a bridge unit, which has precompression of the deck concrete in at least one direction and to methods of forming such a structure.

2. Description of the Prior Art

In the prior art there are a wide variety of structural members, both prefabricated and fabricated in place. These structural members include single element members, such as steel beams, and composite element members with molded materials reinforced with, or supported by, metal bars or support beams and elements. A typical molded material is concrete.

In forming structural members which include concrete or other moldable elements, or which are entirely made of concrete, it has often been found desirable to prestress the concrete to reduce tension loads thereon. It is well known that concrete can withstand relatively high compression stresses but relatively low tension stresses. Accordingly, wherever concrete is to be placed in tension it has been found desirable to prestress the concrete structural member with a compression stress which remains in the structural member so that a failing tension stress is not normally incurred.

Conventional prestressing, as performed in the past, involves stretching a wire or cable through a mold and placing this cable in tension during hardening of concrete which has been poured into the mold. When the concrete has hardened the tension-loaded cable is cut, placing a compression load on the hardened concrete. The compression force from the severed cable remains with the element once it is removed from the mold.

A problem with conventional prestressing is that it requires careful calculations to avoid overstressing the cables because it is usually desirable to stretch the cables to near failure to achieve a sufficient prestressing. The apparatus necessary to achieve this prestressing is also complex. Further, cutting the cables can be a dangerous procedure and can ruin the prestressed structural member if not performed correctly.

In forming structural members for spanning between two supports, it has often been found desirable to utilize a steel structural support beneath a molded concrete surface. Because steel can withstand a much higher tensile stress, these composite structural members are formed with the steel sustaining most of the tensile stress which is placed on the member.

To form composite members of the type having an upper concrete surface and a metal structural support underneath, a metal piece form mold typically is utilized. First, the steel supports, such a wide flange beams, are placed beneath a mold assembly having two or more mold pieces disposed around the beam or beams. Next, the concrete is poured into the mold such that the concrete fills the mold and extends over the beam. When the concrete is hardened, the mold pieces are disassembled from around the beams such that the concrete rests on the beam. In most instances, these wide flange beam supported concrete structural members are formed in place. This is usually advantageous so the concrete surface can better fit into the finished structure. Some types of composite structural members, however, are prefabricated. The prestressing of such composite members may be carried out in a number of ways. One preferred method is disclosed in U.S. Pat. No. 4,493,177 in which the structure is formed in an inverted position.

A problem with large prefabricated structures is that they are difficult to move, and particular problems arise if the location is somewhat remote, as is frequently the case for bridge or building sites in developing countries. In these remote locations it is also difficult to utilize large cranes because of the difficulty in moving them to these locations. The present invention solves this problem by providing a bridge which is easily constructed at the desired location by using relatively small prefabricated panels or composite units which are transversely attached to a plurality of longitudinally extending girders. When the structure is in position, the concrete portion thereof is substantially always in compression. By using fewer longitudinal girders to support the bridge, the present invention also reduces the total weight of structural steel required.

Reduction in the weight of structural steel is also accomplished by the reverse stressing of the girders as they are loaded with the composite units. The bottom flange of each girder, which will have tensile stress when the structure is in its final position, receives and retains compressive stress during the construction process. This prestressing of the girders allows reduction of their weight.

SUMMARY OF THE INVENTION

The composite, prestressed structural member of the present invention may be used in a variety of ways, such as use as a bridge unit. The apparatus comprises a plurality of girders extending in a longitudinal direction and spaced from one another in a transverse direction, and a plurality of adjacent composite structural units disposed above the girders and extending in the transverse direction between the girders. Each composite unit comprises a plurality of transverse beams extending in the transverse direction and attached to a top edge of the girders while the girders are in a construction position supported adjacent to center portions thereof. In this construction position, the free ends of the girders are cantilevered and allowed to deflect downwardly due to the weight thereof and the weight of the composite units thereon. The downward deflection of the girders induces compressive stress in the bottom flanges, which have tensile stress when the structure is placed in its operating position. The compressive stress is retained by attaching the composite units to the girders and filling any joints between the units with high strength grout.

Each composite unit further comprises a molded deck portion disposed at least partially above the beams. Within each composite unit, longitudinal beams are connected to the transversely extending beams of the composite units. Some of these longitudinal beams are positioned directly above and are attached in the field to each of the girders below.

In one embodiment, the molded deck portions are positioned such that a lower edge of each molded unit generally engages a lower edge of an adjacent molded deck unit so that a small gap is defined between facing sides of the molded deck portions. This gap is filled with a grout, preferably of non-shrinking material with a compressive stress at least as great as that of the molded deck.

In an alternate embodiment, the molded deck portions are formed such that when they are positioned on the girders, transversely extending sides of each molded unit are substantially flush with, and abut, the corresponding transverse sides of adjacent molded deck units. Thus, in this embodiment, there is no gap defined between adjacent molded deck portions, and therefore, there is no need for any grout material.

Shear connectors are preferably used to extend from each of the beams, transversely extending and/or longitudinal, over the girders. The corresponding molded deck portion is molded around these connectors.

Preferably, the composite units are formed such that at least a portion of the molded deck portions are placed in compression in the direction of the transversely extending beams. One method of doing this is disclosed in U.S. Pat. No. 4,493,177 wherein the composite units would be formed in an inverted position.

The apparatus may further comprise one or more diaphragms disposed in the longitudinal direction between the transversely extending beams of adjacent composite units.

A method of constructing the prestressed structural member comprises the steps of positioning the girders in the construction position on a construction support adjacent to a center portion of the girders, such that the opposite free ends of the girders cantilever away from the construction support and are free to deflect downwardly due to the weight thereof, and positioning the plurality of composite units on upper portions of the girders. After all of the composite units are positioned on the girders, each unit is attached to the corresponding girder, and any joints between the units are filled with non-shrink, high strength grout. This procedure mobilizes the units to act compositely with the girders. In this way, when the complete structural member is moved from the construction position to an operating position on operational supports, the complete structural member is supported adjacent to opposite ends of the girders such that at least a portion of the molded deck portions are placed in compression in the longitudinal direction.

In one preferred embodiment, the construction support forms at least a portion of, or is located adjacent to, a first operational support for one of the ends of the girders and is spaced from a second operational support. When in the construction position, this one of the ends of the girders extends approximately one-half the distance to the second operational support. Thus, the structure may be constructed quite near to the location of its final use which reduces the distance the completed structural member has to be moved.

One method of moving the complete structural member to its operating position comprises the steps of attaching a girder extension to at least one of the girders at an end thereof nearest to the second operational support such that the girder extension extends to the second operational support and is at least partially supported thereby, and then rolling the complete structural member with the girder extension attached thereto toward the second operational support until the complete structural member is in its operating position on both the first and second operational supports. After the step of rolling, the girder extension may be detached. Counterweights can be used at the free ends of the completed structure and the extensions to reduce the forces at the point of attachment of the extension.

Another method of moving the complete structural member to its operating position comprises attaching a lifting frame to the structural member and lifting the structural member by the lifting frame and setting it down in its operating position. Further, if the construction support engages the girders in spaced locations adjacent to the center portion of the girders, then so long as the longitudinal length of the lifting frame is a least the distance between the support locations, the lifting frame may be used without inducing additional stresses in the structural member during lifting. Because of the construction of the structural member, the lifting frame may therefore have a longitudinal length considerably less than half the longitudinal length of the complete structural member, whereas a conventional structural member with concrete at its top would require a lifting point near the ends of the structural member to avoid putting excessive tensile stress in the concrete.

An important object of the invention is to provide a prestressed structural member which may be easily assembled and which provides compressive prestress in molded deck portions thereof in a longitudinal direction.

Another object of the invention is to provide a prestressed structural apparatus having a plurality of longitudinally extending girders with a plurality of transversely positioned composite units thereon.

Another object of the invention is to provide a method of constructing a prestressed structural member wherein composite structural units are attached to girders which are supported adjacent to a center portion thereof such that opposite free ends of the girders cantilever and are free to deflect due to the weight thereof, thereby inducing compressive stress in the bottom flanges of the girders, and wherein the prestress is retained by attaching the composite structural units to the girders.

An additional object of the invention is to provide a bridge structure with a reduced number of longitudinal supporting girders so that the overall weight of the structural steel in the bridge unit is reduced.

A further object of the invention is to provide a method of forming a prestressed structural member utilizing relatively small composite structural units which are easily transported to the construction site or which are easily formed at the construction site.

Still another object of the invention is to provide a method of moving a prestressed structural member to its operating position without requiring large lifting apparatus.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figures 1, 1A, 1B, 2:
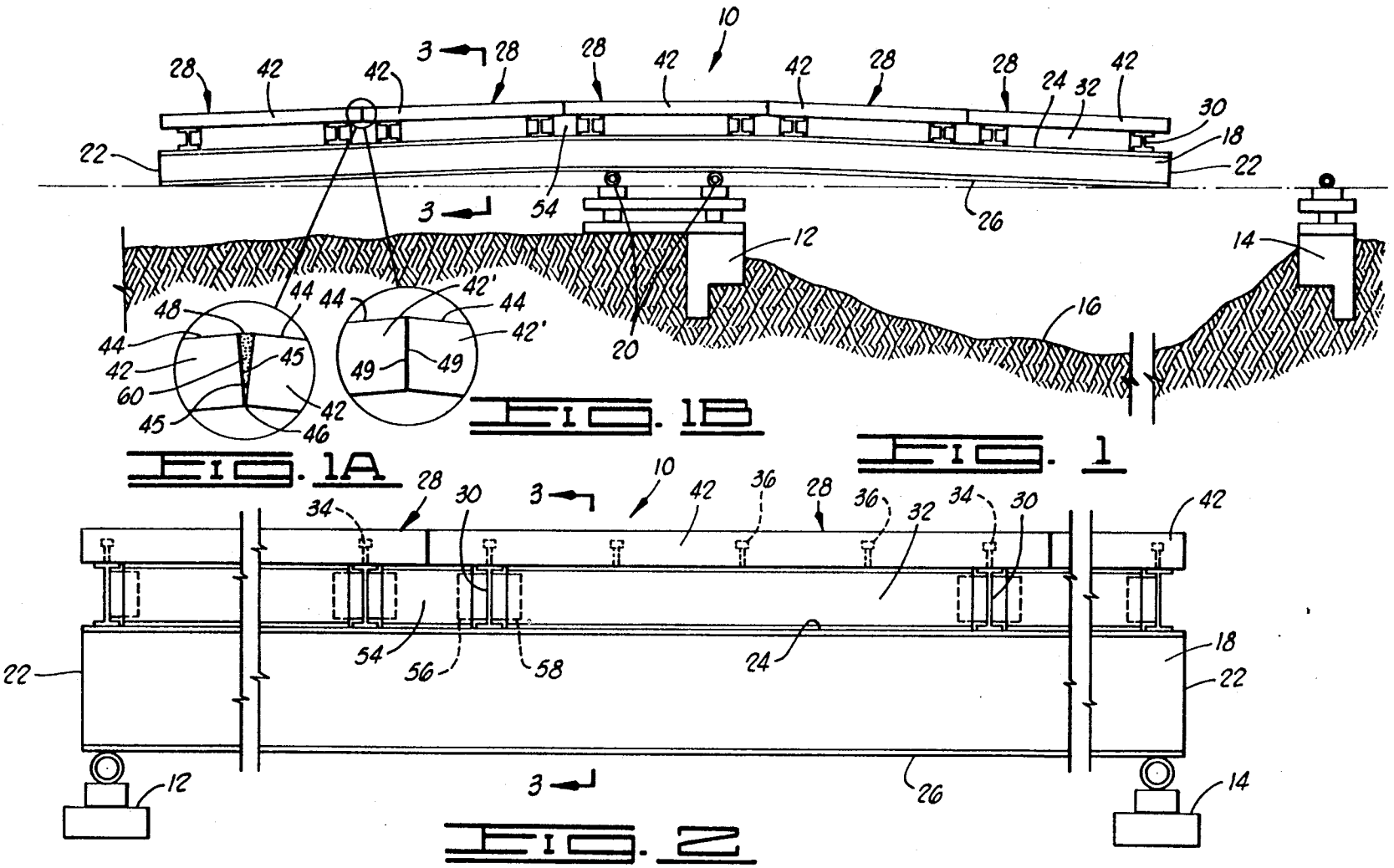
FIG. 1 illustrates the composite prestressed structural apparatus of the present invention in a construction and assembly position.
FIG. 1A shows an enlarged detail of one embodiment of a portion of FIG. 1.
FIG. 1B shows an enlarged detail of an alternate embodiment of a portion of FIG. 1.
FIG. 2 is an enlarged view of the apparatus of the present invention in an operating position.
Figure 3:
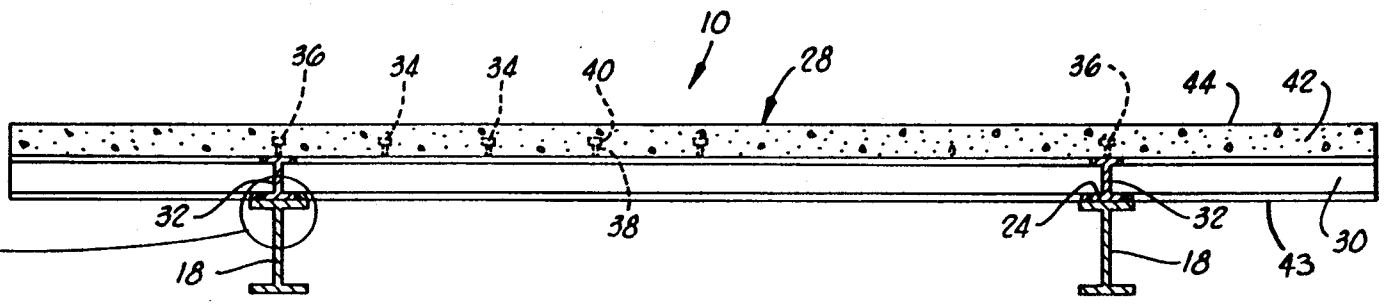
FIG. 3 is a cross-sectional view taken along lines 3—3 in FIG. 2.

Referring now to the drawings, and more particularly to FIGS. 1-3, the composite prestressed structural member of the present invention is shown and generally designated by the numeral 10. In the embodiment shown, member 10 is a bridge structure adapted for extending between a pair of abutments or supports 12 and 14 disposed on opposite sides of whatever is to be bridged, such as a creek 16.

Bridge abutments 12 and 14 are of a kind generally known in the art, and during assembly and construction of member 10, it is supported solely on or adjacent to one of the abutments, such as abutment 12 as illustrated in FIG. 1. Once member 10 has been fully assembled, it is moved by any of several methods to its operating position wherein it is supported on opposite ends thereof by abutments 12 and 14 as shown in FIG. 2. The moving methods will be further discussed herein.

Member 10 comprises a plurality of longitudinally extending girders 18 which are preferably of I-beam configuration. Girders 18 are positioned on double rollers 20 of abutment 12. Girders 18 are supported on rollers 20 adjacent to a center portion of the girders so that the longitudinally opposite ends 2 of the girders cantilever outwardly from rollers 20. Thus, girders 18 extend about one-half of their length toward abutment 14.

In this assembly or construction position, it will be seen that the weight of girders 18 is such that ends 22 deflect downwardly from the center so that the girder takes a somewhat curvilinear shape. Those skilled in the art will know that this places the upper portion of each girder 18, including top edge 24, in tension and places the lower portion of the girder, including bottom edge 26, in compression. As will be further discussed herein, the compression stresses are retained in girders 18 by the eventual attachment of composite units 28 to the girders and the filling of any joints 48 with non-shrink, high strength grout 60. The weight of composite units 28 also adds to the prestressing of girders 18.

In a direction transverse to girders 18, the girders are spaced apart and preferably aligned with the permanent locations they will assume when member 10 is positioned in its operating position on abutments 12 and 14. As seen in FIG. 3, two girders 18 are used, but the invention is not intended to be limited to any particular number.

Member 10 also comprises a plurality of composite units 28, also referred to as transverse units or sections 28, which are positioned on top edge 24 of girders 18. Each transverse unit 28 extends transversely between girders 18, and a portion of each unit 28 may overhang the outermost girders as seen in FIG. 3.

Each transverse unit 28 comprises a plurality of transversely extending beams 30 which extend substantially the entire transverse width of each section 28. Beams 30 are preferably of I-beam construction. Each transverse unit 28 also comprises a plurality of longitudinal beams 32 which extend between transverse beams 30. Longitudinal beams 32 are also preferably of I-beam configuration. Preferably, there is at least one transverse beam 32 which is longitudinally aligned with each girder 18 so that a longitudinal beam 32 extends along top edge 24 of each girder 18. This is best seen in FIGS. 2 and 3.

Extending from the top of transverse beams 30 are a plurality of shear connectors 34. Shear connectors 34 are fixedly attached to the top edge of beams 30. Substantially identical shear connectors 36 are attached to the top edge of longitudinal beams 32. As indicated in FIG. 3, each shear connector 34 and 36 preferably has a shank portion 38 with an enlarged head portion 40 at the outer end thereof, but other kinds of connectors generally known in the art may also be used.

Each transverse unit 28 further comprises a molded deck portion 42. Deck 42 is made of concrete or similar material and is molded around shear connectors 34 and 36 on the upper edges of transverse beams 30 and longitudinal beams 32 to form a composite structure. Preferably, but not by way of limitation, deck 42 is molded such that the deck is prestressed in a manner wherein upper surface 44 of the deck is placed in compression at least in the direction of transverse beams 30 when in the operating position shown in the drawings.

One such method of forming transverse units 28 is that described in U.S. Pat. No. 4,493,177, a copy of which is incorporated herein by reference. Using this method, each transverse unit is constructed in an inverted position such that downward deflection of transverse beams 3 and the mold for forming deck 42 may have downward deflection. The mold is filled with the moldable material, such as concrete, which hardens to form a composite structural member with transverse beam 30 and longitudinal beams 32. During hardening of the moldable material, the mold is deflected so that transverse beams 30 are placed in a stressed condition to form a composite, prestressed structural member upon hardening of the moldable material. Once hardening has occurred, the unit is inverted. When so inverted and supported at outer ends of transverse beams 30, the center portion of the structure will be free to deflect downwardly due to its own weight and due to any loads placed thereon so that the moldable material is substantially always in compression in the direction of transverse beams 30. Thus, the resulting composite, prestressed structure can then be used in member 10 such that most stresses placed on transverse beams 30 between girders 18 are opposite the stresses placed on these beams in the molding process.

In the embodiment shown in FIG. 3, transversely cantilevered portions 43 of transverse composite units 28 extend beyond longitudinal beams 32 and girders 18. The stresses in transverse beams 30 are added to the stresses placed on beams 30 in the molding process. However, the total stress is kept below the allowable. The material of decks 42 undergoes tensile stress in the cantilevered position, but the total stress is kept in compression for dead load and below the allowable tensile stress under live load plus impact.

In an alternate embodiment (not shown), girders 18 and longitudinal beams 32 may be located at the outer ends of transverse beams 30 so that no portions of composite units 28 are cantilevered.

In one embodiment, transverse units 28 have transversely extending sides 45 which are substantially perpendicular to upper surface 44 thereof. Transverse units 28 preferably are positioned adjacent to one another such that lower edges of adjacent decks 42 substantially butt against one another at point 46 as seen in FIGS. 1 and 1A. Because of the previously mentioned curvature of girders 18, a gap 48 is defined between transverse sides 45 of adjacent decks 42.

In an alternate embodiment seen in FIG. 1B, molded deck portions 42' are molded with transverse sides 49 which are not perpendicular to upper surfaces 44. Rather, transverse sides 49 are molded to compensate for the curvature of girders 18 such that sides 49 of adjacent decks 42' are flush and abut one another. In other words, there is no gap formed between adjacent decks 42'.

Figure 3A:
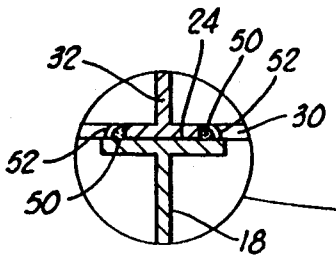
FIG. 3A is an enlarged detail of a portion of FIG. 3.

Referring now to FIG. 3A, longitudinal beams 32 which are positioned on top edges 24 of corresponding girders 18 are fixedly attached to the girders such as by a longitudinally extending weld 50. Another weld 52 which extends substantially transversely to girders 18 is used to attach transverse beams 30 to the corresponding girders.

Referring now to FIG. 2, a short longitudinally extending beam portion or diaphragm 54 may be disposed between adjacent transverse beams 30 on adjacent transverse units 28. Beam portions 54 are substantially aligned with longitudinal beams 32 and thus are positioned between top edge 24 of the corresponding girders 18 and the corresponding molded deck portion 42. Beam portions 54 may be attached to girders 18 by welding to further assist in retaining prestressing in the girders. Beam portions 54 also may be fixedly attached to transverse beams 30 by connecting plates 56 which are welded to both beam portion 54 and the corresponding transverse beams 30. Similar connecting plates 58 may be used to attach longitudinal beams 32 to transverse beams 30 and thus further reinforce the structure of transverse units 28.

After transverse units 28 are welded in place, gaps 48 in the embodiment of FIG. 1A, between adjacent transverse units are filled with a non-shrink, high strength grout 60. After grout 60 has hardened, structural member 10 is ready to be moved into its operating position. In the embodiment of FIG. 1B, no grout is necessary because transverse sides 49 are molded such that they abut one another.

Figure 4:
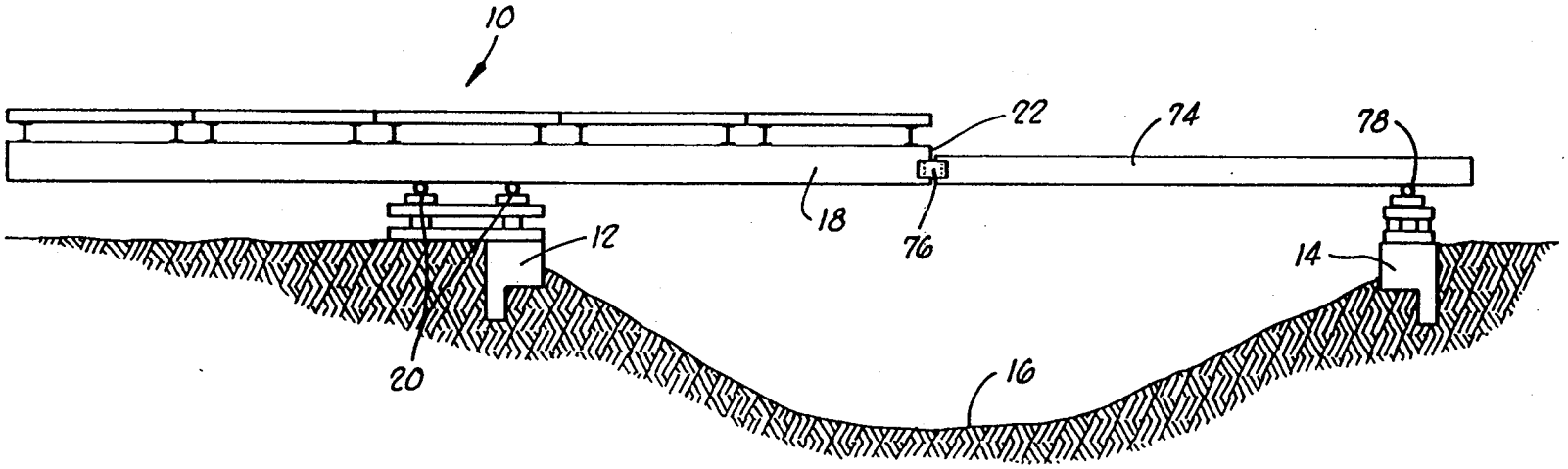
FIG. 4 illustrates the apparatus of the present invention with an extension attached thereto so that the apparatus may be rolled to its operating position.
Figure 5:
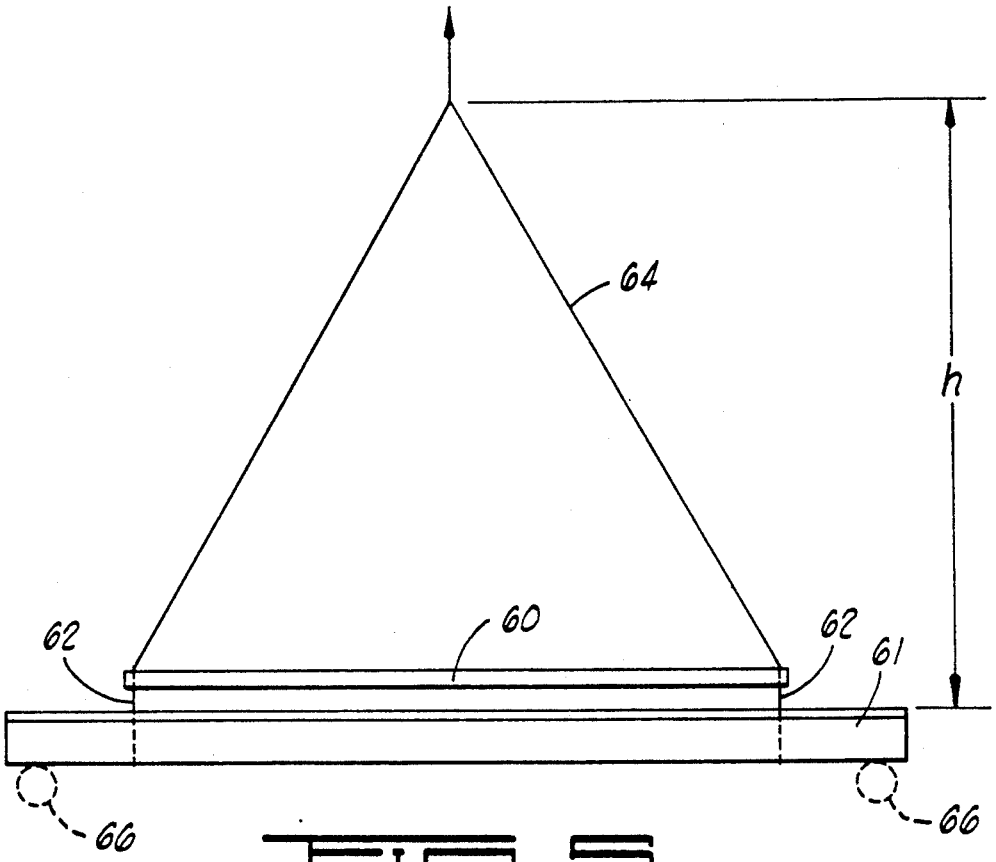
FIG. 5 PRIOR ART
FIG. 5 shows a prior art bridge structure and lifting frame assembly for positioning the bridge structure in an operating position.
Figure 6:
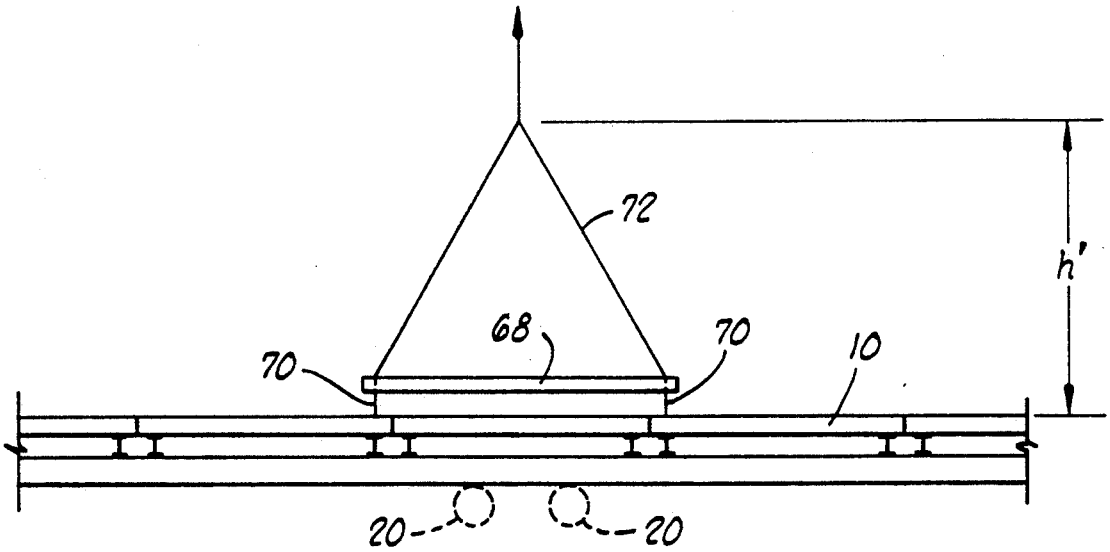
FIG. 6 shows a bridge structure made according to the present invention with a small lifting frame assembly for moving the bridge structure to its operating position.

Referring now to FIGS. 4–6, several methods of positioning member 10 will be discussed. First of all, in FIG. 5, a prior art method of lifting a prior art structural member 61, such as a bridge unit, is illustrated. This method may be used on the present invention, but as will be further explained herein, the prior art method has significant disadvantages and is not necessary for the present invention.

In the prior art method of FIG. 5, a relatively long lifting frame 60 is positioned over prior art structural member 61 (or structural member 10 of the present invention) and attached thereto by prior art connector 62. A lifting cable 64 is attached to opposite ends of lifting frame 60, and the center of cable 64 is engaged by a lifting means, such as a cable or hook at the end of a boom crane (not shown).

Such a prior art lifting system must be relatively long compared to the length of prior art structural member 61 because prior art structural member 61 is supported near its ends on supports 66 when it is formed. Connector 62 must be longitudinally relatively near the points of contact of supports 66, otherwise when structural member 66 is lifted, its ends will deflect downwardly so far that cracking in the molded upper surface thereof may occur because of the induced stresses in the forming process. Generally, it may be said that lifting frame 60 must be approximately eighty percent (substantially more than about half) of the longitudinal length of structural member 61 itself.

By contrast, structural member 10 of the present invention is supported during its construction process on rollers or supports 20 relatively near its longitudinal center, as previously described. In this position, structural member 10 does not have the same induced stresses as prior art structural member 61, and therefore, structural member 10 may be picked up at points nearer to its center without the cracking problems of the prior art. Thus, a relatively short lifting frame 68 may be positioned over structural member 10 and attached thereto by connectors 70. See FIG. 6. Connectors 70 themselves may be of a kind known in the art, substantially similar to connectors 62. A lifting cable 72 is attached to the opposite ends of lifting frame 68, again in a manner known in the art. However, it will be clear by comparing FIGS. 5 and 6 that lifting cable 72 is considerably shorter, and when connected to a cable or hook from a boom crane, considerably less vertical distance is required. Thus, a considerably shorter crane boom, and probably a smaller crane, may be utilized to lift structural member 10 of the present invention with lifting frame 68 than is necessary to lift prior art structural member 61 with lifting frame 60.

As long as the length of lifting frame 68 is at least as much as the longitudinal separation between rollers 20, it will be seen that the stresses induced in the molded upper surface on structural member 10 by this lifting technique will be no greater than those during its construction. That is, the cantilevered portion of structural member 10 during lifting is no greater than during its construction. Thus, there is little danger of cracking during lifting as would be the case in the prior art if such a short lifting frame were used. Generally, it may be said that the length of lifting frame 6 is less than about one-fourth of the length of structural member 10.

EXAMPLE 1

Assume prior art structural member 61 is two hundred feet long supported at its ends during construction. The pickup points must be relatively near the ends, and if it is assumed that the location of the pickup points, where connectors 62 are attached, is twenty feet from each end, lifting frame 60 would be one hundred sixty feet long. This would result in height, h, from lifting frame 60 to the apex of the triangle formed by lifting cable 64 in FIG. 5, being approximately one hundred thirty-eight feet. This corresponds to a boom height of approximately one hundred seventy-nine feet necessary to lift a forty-foot wide structural member 61 forty feet.

EXAMPLE 2

If a fifty-foot-long lifting frame 68 were used, on member 10 of the present invention, the height, h', from lifting frame 68 to the apex of the triangle formed by lifting cable 72 in FIG. 6 would only be approximately forty-three feet. In this case, a boom height of only about eighty-five feet would be necessary to lift a forty-foot wide structural member 10 forty feet using lifting frame 68.

FIG. 4 illustrates a technique of positioning structural member 10 without any substantial lifting. After structural member 10 is formed on rollers 20 as previously described, a girder extension 74 is attached to at least on of girders 18 of structural member 10 by any means known in the art. For example, a plate 76 may be bolted or welded to both girder 18 and extension girder 74. Extension girder 74 is selected to be long enough to extend from end 22 of girder 18 at least as far as roller 78 on abutment 14 on the opposite side of creek 16. Once extension girder 74 is attached, it is a simple matter to roll the entire structure toward abutment 14 until one end of structural member 10 is supported on rollers 20 and the opposite end of structural member 10 is supported on roller 78. At this point, structural member 10 is in its operating position. Extension girder 74 and plate 76 may then be removed, and structural member 10 may then be removed from rollers 20 and set on permanent bearings.

It will be seen, therefore, that the composite, prestressed structural member and methods of forming and positioning same of the present invention are well adapted to carry out the ends and advantages mentioned as well as those inherent therein. While a detailed description of the preferred embodiment and positioning techniques have been shown for the purposes of this disclosure, numerous changes in the methodology and in the arrangement and construction of parts may be made by those skilled in the art. All such changes are encompassed within the scope and spirit of the appended claims.

What is claimed is:

1. A method of constructing a prestressed structural member comprising the steps of:

positioning a plurality of girders in a construction position on a construction support adjacent to a center portion of the girders, such that opposite free ends of said girders cantilever away from said construction support and are free to deflect downwardly due to the weight thereof, said girders extending in a longitudinal direction;

positioning a plurality of composite structural units on upper portions of said girders, each of said composite structural units comprising:

a plurality of transverse beams extending in a transverse direction with respect to said girders and engaging said upper portions thereof; and a molded deck portion engaged with said transverse beams, a transversely extending side of the molded deck portion of each composite structural unit generally facing a transversely extending side of the molded deck portion of an adjacent composite structural unit; and attaching said transverse beams to said girders in said construction, position to form a complete structural member; moving said complete structural member from said construction position to an operating position, wherein said complete structural member is supported adjacent to said opposite ends of said girders, at least some of said molded deck portions are placed in compression in said longitudinal direction.

2. The method of claim 1 wherein each of said composite structural units further comprises a longitudinal beam extending longitudinally with respect to said girders between adjacent transverse beams of the corresponding composite structural unit, each longitudinal beam engaging said upper portion of the corresponding girder and being engaged by the molded deck portion of the corresponding composite structural unit; and further comprising the step of attaching each longitudinal beam to a corresponding girder while said girders are in said construction position.

3. The method of claim 1 further comprising the steps of:

positioning a longitudinal diaphragm between transverse beams of adjacent composite structural units; and attaching said longitudinal diaphragm to said upper portion of the corresponding girder.

4. The method of claim 3 further comprising attaching said diaphragm to an adjacent transverse beam.

5. The method of claim 1 wherein transversely extending sides of adjacent molded deck portions are flush and substantially abut one another when said transverse beams are attached to said girders in said construction position.

6. The method of claim 1 wherein:

transverse gaps are defined between corresponding facing transversely extending sides of adjacent molded deck portions; and said gaps are filled with a high strength grouting material.

7. The method of claim 6 wherein said grouting material has a compressive stress at least as great as a compressive stress of said molded deck portions.

8. The method of claim 1 wherein said step of attaching said transverse beams to said girders comprises welding.

9. The method of claim 1 wherein said construction support is a first operational support for one of said ends of said girders when said complete structural member is in said operating position, said first operational support being spaced from a second operational support used for supporting the opposite of said ends of said girders.

10. The method of claim 9 wherein said girders extend about one-half of a distance between said first and second operational supports.

11. The method of claim 9 further comprising the steps of:

attaching a girder extension to at least one of said girders adjacent to an end thereof nearest to said second operational support, said girder extension extending to said second operational support and being at least partially supported thereby; and rolling said complete structural member with said girder extension attached thereto toward said second operational support until said complete structural member is in said operating position.

12. The method of claim 11 further comprising detaching said girder extension after said step of rolling.

13. The method of claim 1 wherein:

each of said composite structural units further comprises a shear connector extending from said transverse beams; and said molded deck portion is molded around said shear connectors.

14. The method of claim 1 wherein each of said composite structural units is separately formed prior to said step of positioning said plurality of composite structural units on said girders.

15. The method of claim 14 wherein each of said composite structural units is formed in an inverted position such that at least a portion of said molded deck portion is placed in compression in said transverse direction when the corresponding composite structural unit is positioned on said upper portions of said girders.

16. The method of claim 1 further comprising the steps of:

attaching a lifting frame to said complete structural member, said lifting frame having a longitudinal length of less than about one-fourth a longitudinal length of said girders; and lifting said complete structural member by said lifting frame to said operating position.

17. The method of claim 16 wherein:

said construction support engages said center portions of said girders at a pair of locations longitudinally spaced apart; and said longitudinal length of said lifting frame is at least the distance between said locations.

* * * * *